United States Patent [19]

Harris

[11] 4,074,726

[45] Feb. 21, 1978

[54] VERSATILE HAND LOOM

[76] Inventor: Ramsay L. Harris, 1175 W. Baseline Road, Claremont, Calif. 91711

[21] Appl. No.: 661,692

[22] Filed: Feb. 26, 1976

[51] Int. Cl.[2] ..... D03D 29/00

[52] U.S. Cl. ..... 139/29

[58] Field of Search ..... 139/29, 30, 31, 32, 139/33, 55, 57

[56] References Cited

U.S. PATENT DOCUMENTS

| | | | |
|---|---|---|---|
| 511,913 | 1/1894 | Smith et al. | 139/57 |
| 2,114,206 | 4/1938 | Bayan | 139/29 |
| 2,725,900 | 12/1955 | Leuszler | 139/57 |
| 2,783,777 | 3/1957 | Bologna et al. | 139/29 |
| 2,798,512 | 7/1957 | Nadeau | 139/33 |
| 3,332,448 | 7/1967 | Simons | 139/29 |

FOREIGN PATENT DOCUMENTS

| | | | |
|---|---|---|---|
| 806,119 | 8/1951 | Germany | 139/29 |

*Primary Examiner*—Henry S. Jaudon
*Attorney, Agent, or Firm*—Edward O. Ansell

[57] ABSTRACT

A versatile hand operated loom having features making it uniquely suited for utilization in occupational therapy for hospitalized or institutionalized persons. Simplified hand loom assembly dispensing with the conventional shedding harness enables utilization of simplified procedures in dressing and operating the loom, including weaving of the fabric, removal, and setting up the subsequent weaving operation for the same or a different pattern. The hand loom combines a means for uniformly advancing a plurality of warp threads, shuttle means for moving a weft thread in reciprocal motion across the path of the advancing warp threads in a transverse direction, and means for selectively arranging each of said warp threads in an upper or lower position to form a shed through which the shuttle means passes, which combine a movable warp thread holding means cooperating with a preprogrammed pattern member moving in association with the advancement of the warp threads to determine the relative position of each warp thread in conformance with the program contained on said pattern member, whereby a woven fabric of predetermined weave and pattern is obtained. The means for selectively arranging the warp threads to form a shed is constructed to nest within the warp thread advancing means and shuttle means which can be moved on a hinge to permit access to the means for selectively arranging the warp threads. Improved shuttle means and warping and dressing procedures are also disclosed, as well as means for finger weaving on the hand loom assembly.

10 Claims, 22 Drawing Figures

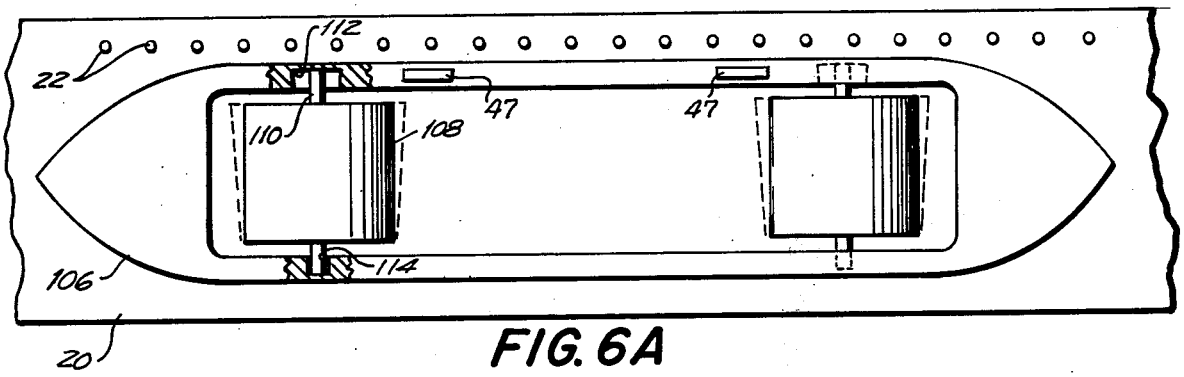
FIG. 6A
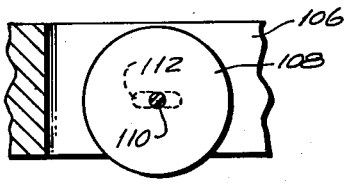
FIG. 6B
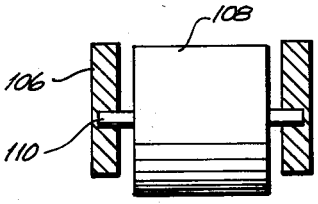
FIG. 6C
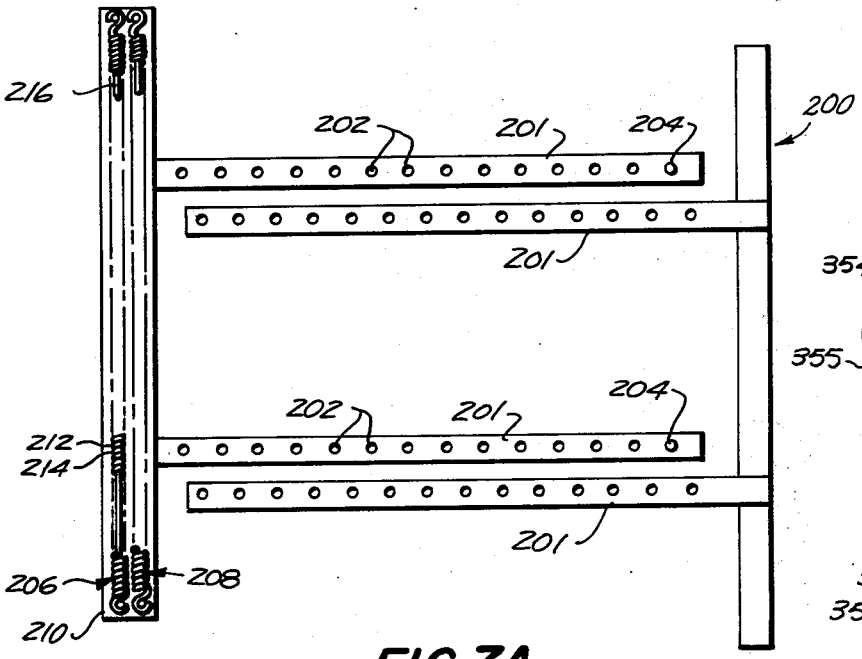
FIG. 7A
FIG. 10B
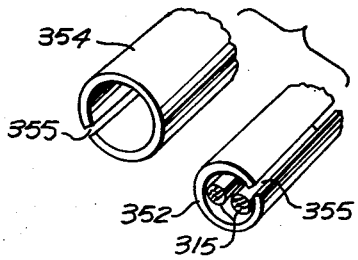
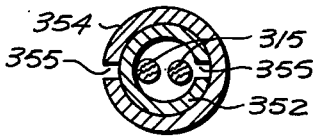
FIG. 10C
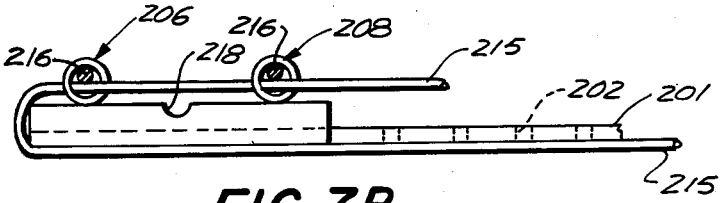
FIG. 7B

VERSATILE HAND LOOM

BACKGROUND OF THE INVENTION

1. Field of the Invention

This invention relates to looms for weaving cloth in general, and to portable hand looms in particular which require no expertise to operate because of the intrinsic use of preprogrammed pattern sheets upon which data representing the desired weave and pattern have been previously entered.

2. Description of the Prior Art

Looms of prior art utilizing conventional shedding harnesses necessitate a tedious process of "dressing" or preparing the loom for use. Further, in many instances, it is difficult, if not impossible to remove a partially completed project from the loom to be set aside and subsequently replaced upon the loom and completed. Additionally, because of the utilization of a harness, the construction of such looms is such that they occupy a great deal of space. Although harness-less looms are not new in the art, many of them are difficult to operate, requiring a certain degree of expertise upon the part of the operator.

While hand looms without harnesses are not unknown, see for example U.S. Pat. No. 3,332,448 to Simons issued July 25, 1967, entitled "Portable Hand Loom for Weaving," the combination of such a construction with a preprogrammed pattern member moving in association with advancing warp threads (as shown in patents to Turner, U.S. Pat. No. 2,305,328, issued Dec. 15, 1942, and entitled "Paper Pattern Indicated Loom Dobby", and the patent to Whitaker, U.S. Pat. No. 2,558,284, issued June 26, 1951 and entitled "Heddle Control for Looms"), combined with the other novel features of the present loom construction and method of operation are unknown and unobvious.

SUMMARY OF THE INVENTION

In its broadest aspect, the present invention relates to a versatile hand loom having features making it uniquely suited for utilization in occupational therapy for hospitalized or institutionalized persons. In its preferred embodiment it comprises a simplified hand loom assembly which dispenses with the conventional shedding harness, thereby enabling utilization of simplified procedures in dressing and operating the loom, including weaving of the fabric, removal, and the setting-up of subsequent weaving operations for the same or a different pattern. The hand loom itself combines a means for uniformly advancing a plurality of warp threads, shuttle means for moving a weft thread in reciprocal motion across the path of the advancing warp threads in a transverse direction, and means for selectively arranging each of said warp threads in an upper or lower position to form a shed through which the shuttle means passes. The latter means comprises a movable warp thread holding means which cooperates with a preprogrammed pattern member moving in association with the advancement of the warp threads to determine the relative position of each warp thread in conformance with the program contained on the pattern member, whereby a woven fabric of predetermined weave and pattern is obtained. The latter means is constructed as a unitary subassembly so the former means can swing outwardly away from it, permitting ready loading and unloading of the pattern member. An improved shuttle is disclosed wherein the shuttle is held to the shuttle board while in transit in either direction. This is achieved by constructing the shuttles to move on rollers, the axles of which are movable in a manner whereby the rollers advance at an angle which slightly deviates to the direction of travel of the shuttle. Unique warping and dressing procedures are also employed, as well as a means for finger weaving on the disclosed hand loom assembly.

BRIEF DESCRIPTION OF THE DRAWINGS

FIG. 6A is a top plan view of the special shuttle of the present invention;

FIG. 6B is a partial end view of the special shuttle, illustrating the elongated roller axle channel at one end of the axle, which enables the shuttle rollers to advance in a direction which is at a slight angular deviation from the direction of travel of the shuttle;

FIG. 6C is an end plan view of the shuttle;

FIG. 7A illustrates the construction of an adjustable warp frame utilized in warping the hand loom of the present invention;

FIG. 7B shows the arrangement of the warp threads with respect to the coil springs;

FIGS. 10B and 10C disclose the construction of the selvedge holders, shown in place in FIG. 10A, and their relationship to the warp threads;

DESCRIPTION OF THE PREFERRED EMBODIMENTS

Figure 1A:
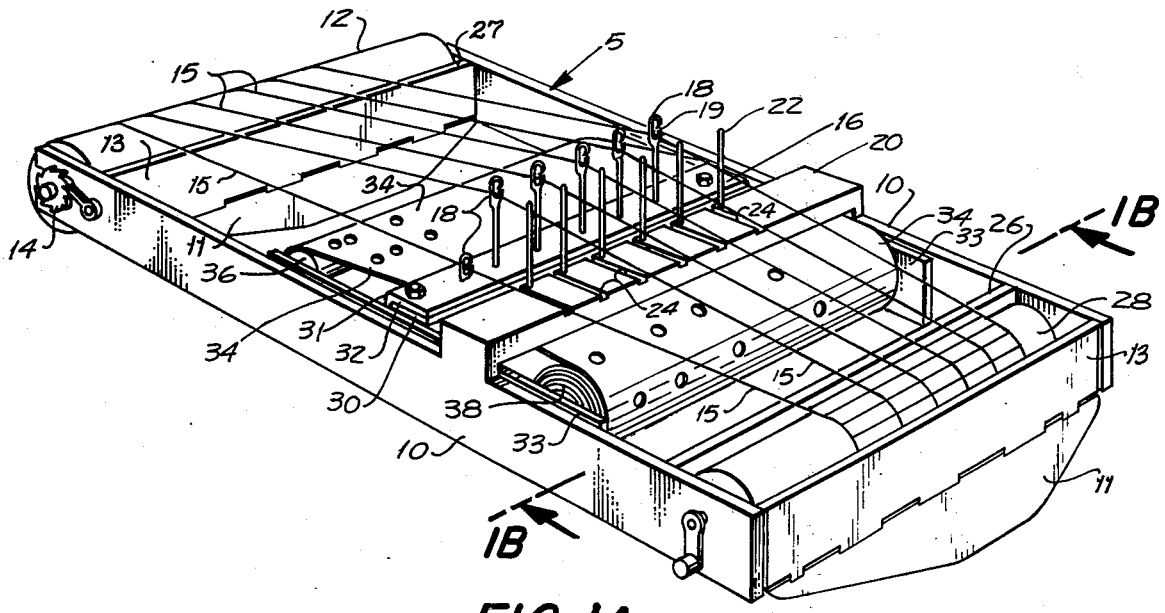
FIG. 1A is an overall perspective view of the loom assembly, with the shuttle mechanism removed.

As may be seen from FIGS. 1 through 4, in its broadest aspect, the loom assembly 5 utilizes a warp beam 12 and cloth beam 28 arranged between parallel sideboards 10 and associated components to be hereinafter described. Also transversely associated with the parallel sideboards 10 are rocker members 11 adjacent to both the ends housing the warp beam 12 and cloth beam 28, rocker support members 13 being attached by a hinge to one or more of the rocker members 11, to be extended to give rigid horizontal support when the loom assembly 5 is not being rocked. When the loom is dressed, as hereinafter described, the warp threads 15 progress from the warp beam 12 through a plurality of warp holding members 18, hereinafter "heddles, " arranged on a warp bar 16 which selectively raises or lowers them in accordance with a predetermined program, as will also be hereinafter described. A heddle 18 is provided for each warp thread 15, each member having a slotted head portion 19 (also see FIG. 9), adapted to receive the warp thread 15. A grooved shuttleboard 20 bearing a plurality of upright reeds is suspended between the sideboards 10 and arranged between the warp bar 16 and the cloth beam 28. The function of the shuttleboard 20 is two-fold; beside providing a transit path for the shuttles 45, the grooves 24 therein accommodate the warp threads 15 below the upper surface of the board 20 along which the shuttles 45 providing the weft, or cross-threads, move in a transverse direction as the loom is rocked (see FIG. 4). The shuttles 45 move through the shed formed by the upper and lower warp threads 15 as will be later described. The reeds 22, of course, serve to keep the warp threads 15 aligned, the threads 15 being tensioned between the warp beam 12 and cloth beam 28 by the frame edge 26, the heddles 18, and the edge 27 of the frame adjacent the warp beam 12.

As further discussed at pages 380 et seq of "The Way Things Work," Volume 1, (Simon and Shuster), Copyright 1967, and the publication "Weaving" by Shirley Held, (Holt, Rinehart & Winston), 1973, the pattern and weave of a cloth is determined by the arrangement and colors of the warp and weft threads. In the present loom assembly 5, the pattern and weave of the cloth is determined by a preprogrammed member 34 (see FIG. 3A) which, in the present embodiment, comprises a plastic perforated pattern member adapted to move between a feed roller 36 and a take-up roller 38 through the warp bar assembly 16 which comprises an upper guide 31 and associated perforated members 30, 32, which are adapted to receive the lower portion of corresponding heddle 18. As the perforated pattern 34 moves through the warp bar assembly 16, the presence or absence of perforations in the programmed member 34 determines whether the respective heddle 18 will be in its upper or lower position, that is, the presence of a perforation determines the lower position of a corresponding heddle and the absence of a perforation determines the upper position thereof, thus establishing the shed through which the shuttle 45 may travel in a manner to be described. It is noted that in this loom assembly 5, the shuttles 45 travel along a smooth shuttleboard 20 by the force of gravity as the loom is rocked to and fro upon the rocker members 11, the lower warp threads 15 forming the shed being recessed in the shuttle board grooves 24. In many conventional looms, the shuttle must travel across the warps with attendant friction and less efficient operation, a disadvantage eliminated in the present construction.

Figure 1B:
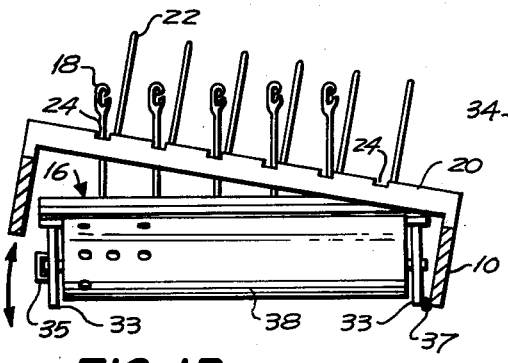
FIG. 1B illustrates the construction of the present loom wherein the means for selectively arranging the warp threads to form a shed nests with other loom components which hingedly move about it, to permit loading or unloading of the preprogrammed pattern member with comparative ease.
Figure 2:
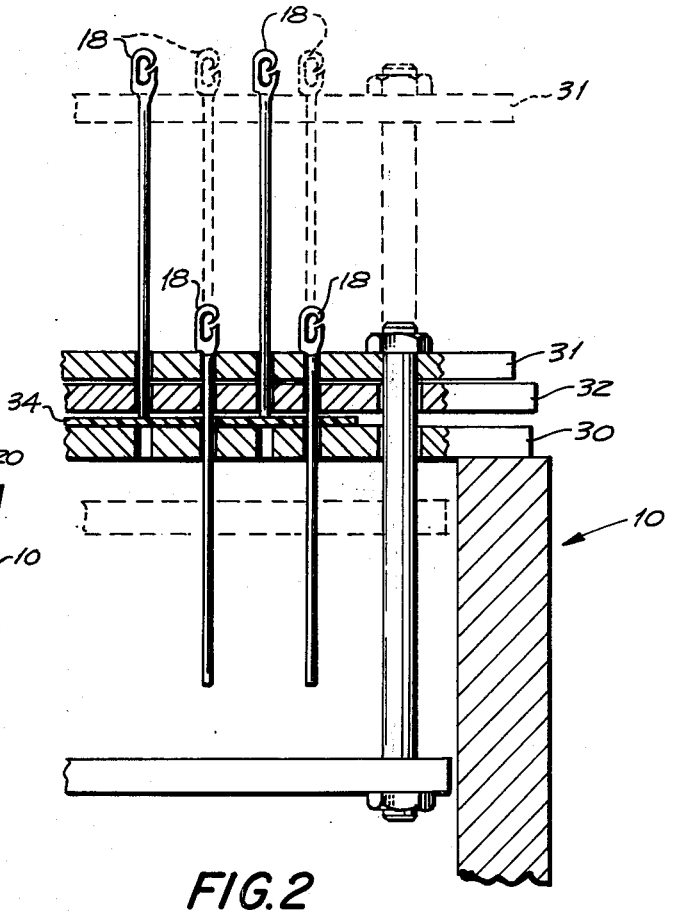
FIG. 2 is a fragmentary end view illustrating how insertion of the perforated program member operates to actuate the warp-holding members in a manner whereby the warp threads are adapted to receive the shuttle.

To permit patterns to be quickly and easily loaded or removed, the feed roll 36, warp bar assembly 16, and take-up roll 38 form a unitary sub-assembly which nests within the remainder of the loom assembly 5, being shown in FIG. 1 as being held together by a feed pattern sub-assembly frame 33. One side of the sub-assembly frame 33 is attached to one of the loom assembly side boards 10 by a hinge member 37, as shown in FIG. 1B. The loom assembly 5 can thus lift upwardly about the hinge 37 to expose (a) the feed roll 36,(b) warp bar assembly 16 which comprises the upper guide 31 and associated perforated members 30, 32; and (c) the take-up roll 38, which stands ready to accept or yield up the programmed pattern member 34.

Figure 3:
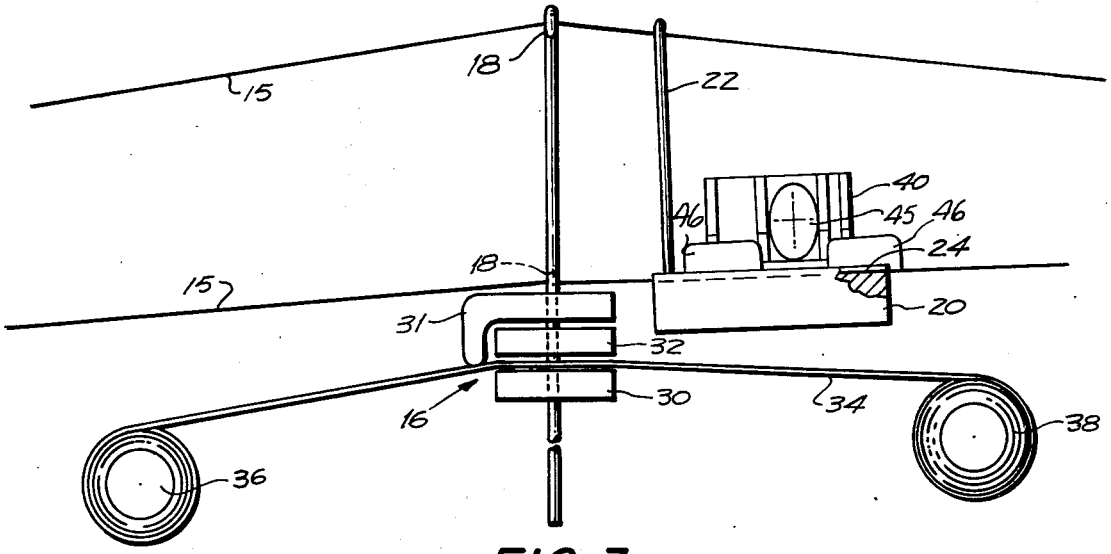
FIG. 3 is a schematic plan view illustrating the relationship between actuated warp-holding members, the program member, and the upright reeds in the shuttle board along which the shuttle slides.
Figure 4:
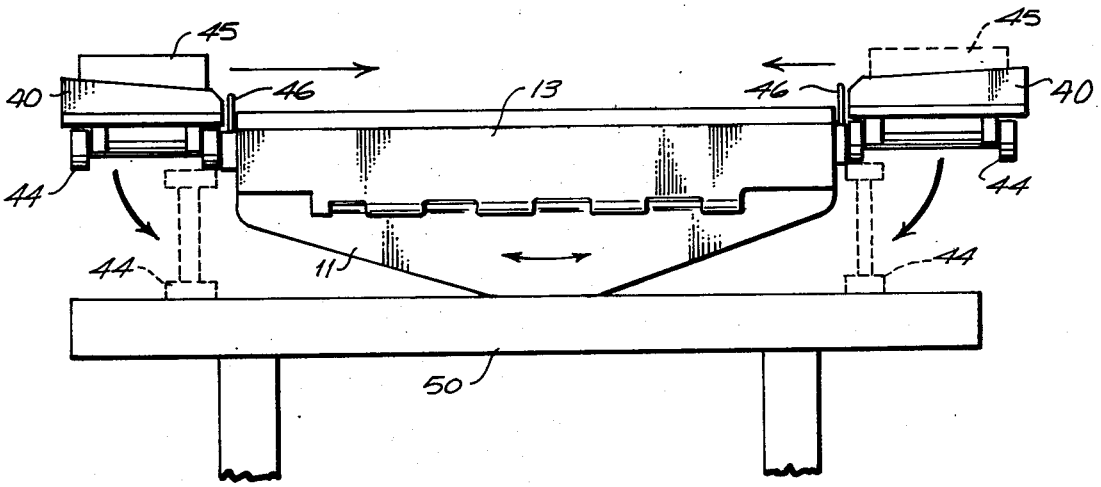
FIG. 4 is an end view of the loom assembly showing the arrangement of the shuttle boxes and the mechanism whereby the shuttles are actuated by a rocking motion.
Figure 5:
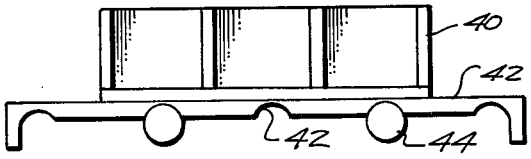
FIG. 5 illustrates the details of the shuttle boxes.

FIGS. 4 and 5 illustrate in more detail the means for handling shuttles 45 with various colors or textures of yarn or weft. In the drawings, the shuttle holder 40 is a three compartment shelf for the shuttles 45, open above and at the side nearest the loom assembly 5. The shuttle holder 40 is supported on two grooved members 42 adapted to receive support dowels 44 which are hinged in a manner whereby they can be lowered, forming added support to the loom assembly 5 when not in use to support the shuttle holders 40. When in operation the support dowels 44 are moved to bring each of the shuttle spaces in the shuttle holders 40 directly in line with the shuttle board 20. Two such shuttle holders 40, one on each side of the loom 5, adjacent the side boards 10, enable the weaver to employ five shuttles, each with a different color or texture of yarn. The shuttles 45 temporarily inactivated are kept in their separate compartments by a restraining unit 46, as shown in FIGS. 3 and 4 such as a small raised member or tiny wall extending laterally on each side of the loom assembly 5, but leaving a clear space for the shuttle to leave the shuttle holder 40 and slide on to or off the shuttle board 20, the loom assembly 5 as it is rocked from side to side.

Insertion of recessed magnets 47 in the internal structure of the shuttle members 45 can be utilized to keep the shuttle attracted toward the metallic reeds 22 as the shuttle members 45 gravitationally traverse the shuttle board 20 or, with recessed magnets in the bottom of the shuttle member 45, the shuttle could follow a strip of metal or a series of metal inserts along the length of the shuttle board 20. In FIGS. 6A, B and C, however, I show a special "keep-to-one-side" shuttle assembly 100 equipped with one or more rollers 108 which tend to always keep the shuttle 106 in contact with the reed uprights 22, thus offsetting any possibility of the shuttle 106 falling off the shuttle board 20 as it is rocked to and fro. The shuttle 106 utilizes rollers 108 rotating with axle 110 extending through restricted axle channel 114 to an elongated axle channel 112 on the other side of the shuttle 106, space 112 being a lateral slot which permits the roller 108 to face inwards toward the reed uprights 22. Thus, whichever way the shuttle 106 moves due to the inclination of the shuttle board 20, the unrestricted end of the axle 110 slides to the far end of the elongated axle channel 112, insuring the inward movement of the rollers 108 to direct the shuttle 106 toward the reed uprights 22.

OPERATION OF THE LOOM

I have developed a series of simplified procedures involved in the operation of my hand loom including winding the warp threads; dressing the loom; weaving the fabric; removing it; and setting up the next job. As will be hereinafter described, principal advantages to be achieved from my hand loom are: ease in warping; ease and speed in dressing; availability of an infinite variety of patterns on quickly installed, quickly changed pattern rolls; ease and convenience in handling a plurality of shuttles; control of draw-in or narrowing of the weft; ease and speed in attaching outgoing warp ends to incoming warps; and substantial reduction of usual loom waste or waste of warp threads from what has heretofore been 27 to 30 inches per warp to some 4 inches per warp in going from on job to the next.

Warping a loom is the process of preparing the warping yarns for the loom. As shown in FIGS. 7A and 7B, with the present loom assembly, warp threads 215 are first wound on an adjustable warp frame 200 which may have measurements imprinted beside the various holes 202 in the frame arms 201. To secure any given length, placement pegs 204 are inserted in the holes 202 which would cause the frame arms 201 to correspond to the length desired. Two coil springs 206, 208 are extended parallel to each other on a frame side 210. These coil springs 206, 208 are extended in whole or serially in equal sections to receive one warp thread 215 between each successive pair of coils 212, 214. When released, the springs 206, 208 hold the warp threads 215 firmly. The number of warp threads 215 matches the number of heddles 18 (see FIG. 1 et seq) on the loom assembly 5. After insertion of warp threads 215 into the coils 212, 214 of the springs 206, 208, each spring will be rendered rigid by either insertion of a rigid member 216 through the length of each spring 206, 208 or relating a rigid member to the outside of each spring. Such rigid members 216 may be adjusted to take a firm placement on the cloth beam 28 and warp beam 12 respectively. Each such rigid member 216 may also be devised as to tighten further the normal contractive pressure of the springs 206, 208 to hold the warps 215. Finally, the warp threads 215 leading from one spring 206 to the other spring 208 are cut in line with the slot 218 thereby releasing two warp-holding sticks, for placement on the loom assembly 5, as will be hereinafter described.

Figure 8:
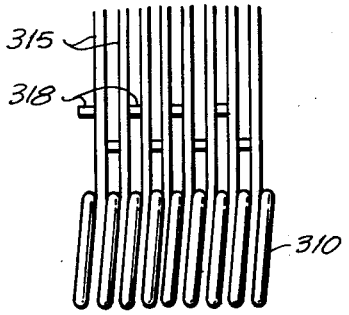
FIG. 8 shows the arrangement of the warp threads secured by warp-holding "sticks" of FIG. 7 with respect to the warp-holding members of the loom of the present invention.
Figure 9:
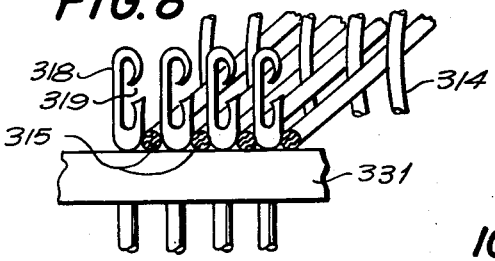
FIG. 9 is a view showing said arrangement.

To dress the loom, that is, prepare the loom for weaving, the following procedure will be best understood in connection with FIGS. 8, 9 and 10. A warp-holding stick 310 is attached to the warp beam 312 and the warp threads 315 rolled onto the warp beam 312 until the other stick can be drawn taut, slightly beyond the line of the warp-holding members (or heddles) 318 in even alignment. Since the warp threads 315 on each stick 310 are aligned to match the heddles 318 in both number and spacing, the stick 310 carries one warp thread 315 on the entry side of each heddle 318. The stick 310 is then drawn down, then sideways, and upwards on the entry side of the heddles 318, whereby the warp threads 315 enter into slots 319 in each heddle 318, the stick 310 then being lowered to bring the warps 315 to the bottom of the slots 319. The warp beam 312 is then released to permit the stick 310 to be drawn outward to its placement on the cloth beam 328 or the cloth stick or to attachment as a cloth stick itself. In the operation just described, the warp threads 315 remain firmly gripped between the spring coil 314.

To insure against any possibility of warp threads 315 accidentally slipping out of the slot 319 of the heddles 318, the warp threads 315 from the cloth beam 328 meet the line of heddles 318 at a right angle, but from the heddles 318 to the warp beam 312, the warp threads 315 deviate slightly at an angle Θ 320 in order to insure the retention of the warp threads 315 within the slotted heddle 318, as it moves up and down in the upper guide member 331 in accordance with the preprogrammed operations to be described hereinafter.

Figure 3A:
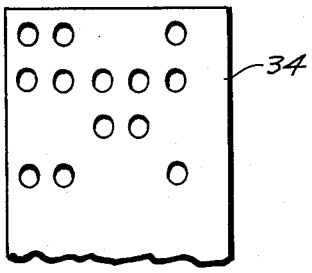
FIG. 3A is an enlarged illustration of the perforated program member.

The preprogrammed member 34, shown in FIG. 3A, consists of a thin, tough material in a sheet wound to travel between a pattern feed roller 36 and pattern take-up roller 38. A roller control mechanism 35 permits the pattern sheet 34 to remain static, to move forward or backward as required, or to move forward or backward in continued, automatic sequence of pattern-row after pattern-row. As illustrated in FIG. 1B, the roller control mechanism 35 may be a knob arranged on a pulley mounted on the shaft of the take-up roller 38, coupled by belt to the shaft of the feed roller 36, thereby permitting manual manipulation of the pattern sheet 34. Alternatively, the roller control mechanism 35 could comprise a knob on the shaft of each roller 36, 38 or any other means of moving the rollers known to those skilled in the art. The pattern-rows of perforations in programmed sheet 34 are in parallel alignment with the vertical rows of warp holding heddles 18.

For each shed, a hand lever or foot pedal (not shown) raises the control frame of warp-holding heddles 18, so their flat lower ends are all well above the level of the pattern sheet 34 below. The roll of perforations for the next shed is brought into place below the heddles and centered. When the control frame is lowered by reverse pedal or lever action, those heddles 18, coinciding with perforation holes below them, slide through to form a bottom row of warps in the shed. Those heddles with unperforated sheeting below them stand erect, thus supplying the upper warps of the shed.

The shuttle 45 can be sent across the shuttle board 20 both ways by tilting the loom 5 on the rocker members 11. Thus the rocker members 11 may rest in three different positions: horizontal; tilted to the right; or tilted to the left. The shuttle board 20 is made to slope slightly upward in the direction of the cloth beam 28, thereby causing the shuttles 45 to move securely within the slight depression formed between the upward-sloping shuttle board 20 and the reed units 22 at right angles to the plane of the shuttle board 20.

The warp threads 15 slope upward toward the heddles 18 in lowered position. This upward slope is slightly greater than that of the shuttle board 20. From the heddles in lowered position, the warp threads 15 slope parallel with the slope of the shuttle board 20 toward the cloth beam 28. The heddles in lowered position hold the warp threads slightly below the level of the surface of the shuttle board 20. The warps 15 therefore occupy the slots or grooves 24 in the shuttle board 20. These slots 24 are cut at right angles to the length of the shuttle board 20, and between the metal units of the reeds 22. Since the warp threads 15 are below the level of the surface of the shuttle board 20, the shuttle 45 can slide above them without friction against the warps 15.

The present loom assembly 5 could be constructed without conventional reed members 22, the packing of the weft being done by a "dolphin" topless reed attached to a beater frame (not shown). Vertical upright metal units would rise from below the level of the warps 15, push their very smoothly rounded tops through the warps 15, advance and pack the weft and retrace their way back out of sight.

Two shuttle holders 40, as previously described, are hinged at opposite ends of the shuttle board 20 at the loom assembly sideboards 10. The shuttle holders 40 hang downwardly when out of use to save space. Such holders 40 may hold three, five, or even seven shuttles 45 with yarns of varying textures and colors. Each shuttle holder 40 is arranged to slide forward or backward along the sideboards 10 to bring the desired shuttle 45 in line with entrance onto the shuttle board 20 for any given shed.

Figure 10A:
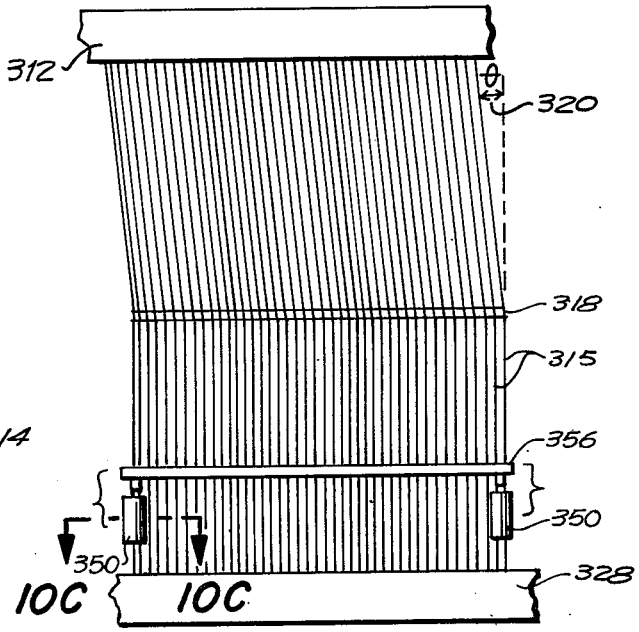
FIG 10A is a top plan view showing the placement of the warp threads in the warp-holding members of the loom between the warp beam and cloth beam.

As described in FIGS. 10A, 10B and 10C, to help maintain even width of the web and to avoid draw-in, selvedge holders 350 comprising short lengths of semi-rigid or rigid tubing 352, 354 may be placed over the extreme left and right warps, that is, the selvedges. The weft slides over these holders 350, which are held apart at the desired width by one or more temples 356, and progressively replaced as the work proceeds. The tubes may also be held apart by adjustable hook-ends movably attached to the insides of the loom frame. These are removed and readjusted as the work proceeds. Each selvedge holder 350 comprises two tubular members 352, 354, each of which has a slit 355 down the length thereof to take the warp thread or threads. When the inner tube 352 has been placed over the warp threads 315, the outer tube 354 is slipped over it to form a single, substantially rigid selvedge holder 350. If of the same diameter, the inner tube 352 would have a wider slit 355 to allow for compression within the outer tube 354.

Figure 11A:
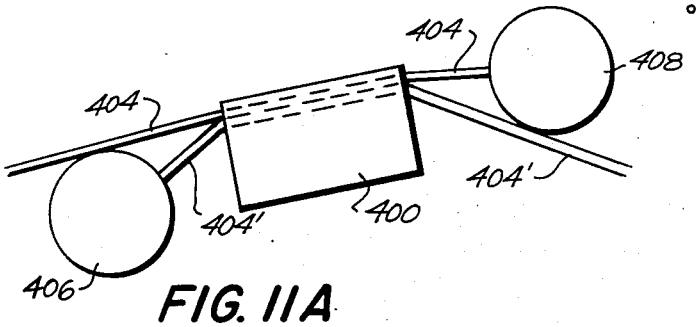
FIGS. 11A, B and C illustrate the utilization of splicing sticks to dress the loom for new work with a minimum of wastage.
Figure 11B:
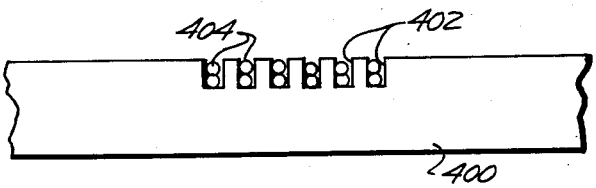
Figure 11C:
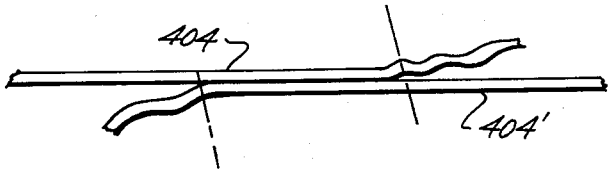

The technique for dressing the loom for new work is best understood with reference to FIGS. 11A, 11B and 11C. When delivery of the warp threads 404 from the warp beam comes to a stop, the beginning warp ends of the new project are spliced to the terminal ends of the one presently on the loom. (See FIG. 11C.) A straight, flat, inch-narrow, rigid unit 400 is placed below the warp threads 404 next to the warp-holding sticks 406, 408 attaching them to the warp beam. Shallow, warp-wide slits 402 in the upper surface of the unit 400 match the warps 404, which slip into the matching slits 402. Glue is then worked into the slits 402 to impregnate the upper surfaces of the warps 404 inside the slits 402. The cloth beam "stick" end 408 for the new job is placed in closed parallel over the slotted unit 400 so as to bring the new warp threads 404 in corresponding slits 402 and in firm contact with glue-impregnated warps. This procedure provides a quick, wholesale splicing of the terminal ends of the almost completed job with the beginning ends of the new job.

When the glue has set, the warp beam and the cloth beam "sticks" 406, 408 for the new job are both cut away. Warp beam stick 406 for the new job is attached to the warp beam, rolled up, and placed in position on the loom. Weaving on the old job now re-commences and proceeds until the spliced ends reach the line of warp-holding heddles. The warp beam is now removed, rolled up fairly close to the heddles, and the warps are worked out of the side slots in the heddle eyes and downwardly. The cloth beam is turned so as to draw the spliced ends between the warp holding heddles, the warp beam is operated to bring the warps back into the slots in the heddles, and the warp beam is then replaced on the loom. Weaving continues until the weft reaches the splicings. The new job is begun on the other side of the splicings. In practice, I have found that by following this procedure a total loom waste per warp of some four inches results. When the new weft approaches the cloth beam, a new spring stick takes the new warp ends into firmly held alignment, as previously described. The warps are cut to detach the old job, along with the splicings. The new "stick" is then attached to the cloth beam, and weaving continues on the new job.

Figure 12A:
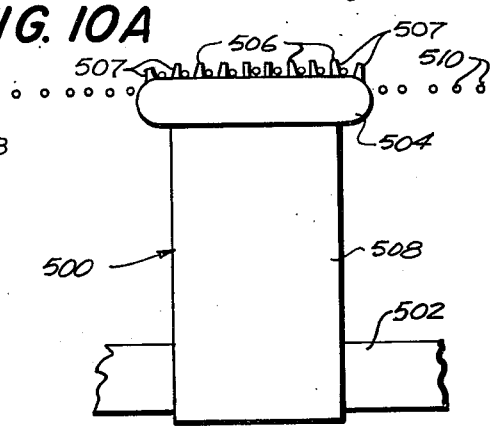
FIG. 12A is a plan view of a finger weaving attachment for the hand loom of the present invention, showing initial engagement of the attachment with the warp threads.
Figure 12B:
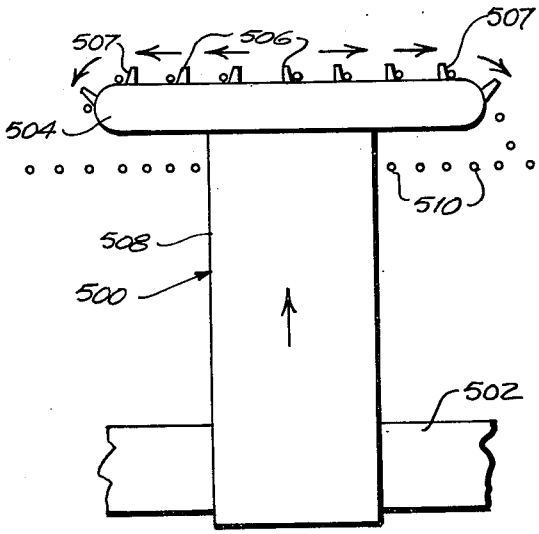
FIG. 12B shows operation of the attachment to extend the warp threads in a manner easing finger weaving of weft threads.

A distinct advantage for experienced weavers, who have customarily worked with fifteen and twenty warps to the inch, is also enjoyed by the utilization of the present hand loom assembly. As shown in FIGS. 12A and 12B, to render finger weaving possible and simpler a finger weaving unit 500 is mounted, either integrally or movably, at a convenient place under the warp threads 510 in the proximity of the shuttle board. The finger weaving unit comprises a warp holder 504 arranged to move up and down on a warp holder extension 508 which in turn is mounted on a cross bar, thereby enabling the warp holder 504 to be raised or lowered along the warp holder extension 508 at any place under the warp threads 510 at a position of left to right of the loom as the warp holder extension 508 is moved along the cross bar 502. The warp holder 504 is made lockable in the upward position, its surface having warp separator extensions 506 thereon to hold warp threads 510 and spread them out at small, even distances from each other. This makes it possible for the weaver to employ finger weaving and to do so more readily than when the warps 510 are in their customary close position beside each other.

The lateral extension to space out the warps 510 is accomplished by the simple wedge or cam action of the ramp 507 on the warp separator extrusions 506 as the warp holder 504 is raised beyond the level of the warp threads. Thus the finger weaving unit 500 rises from below the warp 510, placing the small extrusions between the warps 510 in their close alignment. As the warp holder 504 rises further, the extrusions 506 move the centrally raised warps 510 away from each other to both left and right and drop some of those warps at its right and left sides. When lowering of the finger weaving unit 500 begins, the surface holding the spaced-out warps 510, that is the warp separator extrusions 506, immediately draws inward toward the center, returning to the original width at its surfacing to the level of the warp threads 510 on the shuttle board.

I claim:

1. A loom assembly comprising:

a base member including at least two essentially parallel longitudinal side members;

a warp roller rotatably secured at one end of said base between said side members;

a take-up roller rotatably secured at the other end of said base between said side members;

said rollers being rotatable in the same direction, thereby being adapted to carry warp thread from the first roller to the second;

a warp bar arranged intermediate said rollers and between said side members, said warp bar having a plurality of heddles slidably mounted thereon for vertical, alternate reciprocation and when having warp thread therein, the rising of one heddle and the falling of an adjacent heddle providing alternate warp threads in spaced relation to form a shed;

a shuttle board arranged between said side members adjacent said warp bar in the direction of the take-up roller, said shuttle board having a plurality of upright reeds thereon to align the warp threads as they travel from the warp roller through the heddles to the take-up roller;

shuttle means for moving a weft thread solely by gravitational forces in reciprocal motion on the surface of said shuttle board across the path of said warp threads in a transverse direction as said warp threads advance;

means for selectively moving a preprogrammed pattern member in association with the advancement of said warp threads, said pattern member cooperating with said heddle members to determine the relative position of each warp thread in said heddle member in conformance with preselected instructions contained upon said pattern member;

said base member, take-up and warp rollers, warp bar, shuttle board and shuttle means together being movable in a vertical plane away from said pattern movement means which nests among them to permit ready insertion or removal of preprogrammed pattern members in said pattern movement means and in addition, means to maintain over width of the web formed by the weaving of warp and weft threads comprising selvedge holders arranged over the extreme right and left warps, and temples arranged to hold said selvedge holders apart to the desired width.

2. A loom assembly comprising:

a base member including at least two essentially parallel longitudinal side members;

a warp roller rotatably secured at one end of said base between said side members;

a take-up roller rotatably secured at the other end of said base between said side members;

said rollers being rotatable in the same direction, thereby being adapted to carry warp thread from the first roller to the second;

a warp bar arranged intermediate said rollers and between said side members, said warp bar having a plurality of heddles slidably mounted thereon for vertical, alternate reciprocation and when having warp thread therein, the rising of one heddle and the falling of an adjacent heddle providing alternate warp threads in spaced relation to form a shed;

a shuttle board arranged between said side members adjacent said warp bar in the direction of the take-up roller, said shuttle board having a plurality of upright reeds thereon to align the warp threads as they travel from the warp roller through the heddles to the take-up roller;

shuttle means for moving a weft thread solely by gravitational forces in reciprocal motion on the surface of said shuttle board across the path of said warp threads in a transverse direction as said warp threads advance;

means for selectively moving a preprogrammed pattern member in association with the advancement of said warp threads, said pattern member cooperating with said heddle members to determine the relative position of each warp thread in said heddle member in conformance with preselected instructions contained upon said pattern member;

said base member, take-up and warp rollers, warp bar, shuttle board and shuttle means together being movable in a vertical plane away from said pattern movement means which nests among them to permit ready insertion or removal of preprogrammed pattern members in said pattern movement means; and a finger weaving unit arranged in proximity to the shuttle board, said finger weaving unit comprising: a warp holder, a warp holder extension which accommodates vertical movement of said warp holder, a cross bar on which is mounted said warp holder extension, and warp separator extensions having a ramped surface arranged upon said warp holder, whereby the warp holder may be raised or lowered along the warp holder extension at any place under the warp threads at any position to the right or left of the loom assembly as the warp holder extension is moved along the cross bar, and the warp threads are spread out at small distances from each other as the warp holder is arranged in its upward position to make the warp threads move accessible for finger weaving.

3. A loom assembly comprising:

a base member including at least two essentially parallel longitudinal side members;

a warp roller rotatably secured at one end of said base between said side members;

a take-up roller rotatably secured at the other end of said base between said side members;

said rollers being rotatable in the same direction, thereby being adapted to carry warp thread from the first roller to the second;

a warp bar arranged intermediate said rollers and between said side members, said warp bar having a plurality of heddles slidably mounted thereon for vertical, alternate reciprocation and when having warp thread therein, the rising of one heddle and the falling of an adjacent heddle providing alternate warp threads in spaced relation to form a shed;

a shuttle board arranged between said side members adjacent said warp bar in the direction of the take-up roller, said shuttle board having a plurality of upright reeds thereon to align the warp threads as they travel from the warp roller through the heddles to the take-up roller;

shuttle means for moving a weft thread solely by gravitational forces in reciprocal motion on the surface of said shuttle board across the path of said warp threads in a transverse direction as said warp threads advance;

means for selectively moving a preprogrammed pattern member in association with the advancement of said warp threads, said pattern member cooperating with said heddle members to determine the relative position of each warp thread in said heddle member in conformance with preselected instructions contained upon said pattern members;

said base member, take-up and warp rollers, warp bar, shuttle board and shuttle means together being movable in a vertical plane away from said pattern movement means which nests among them to permit ready insertion or removal of preprogrammed pattern members in said pattern movement means, and a pair of warp holding sticks comprising:

an adjustable warp frame, having two lateral side members;

two extendable coil springs extended parallel to each other on one of said two lateral side members, said coil springs being adapted to receive a single warp thread between each adjacent pair of coils within each said coil spring when said coil springs are extended; and a rigid member inserted laterally through the length of each coil spring to render it rigid;

said lateral side member on which said coil springs are mounted having a slot therein to ease the cutting of warp threads extending between said coil springs, thereby releasing two warpholding sticks for placement on the loom assembly.

4. In a hand loom, the combination comprising: means for uniformly advancing a plurality of warp threads in a first direction;

shuttle means including a shuttle board for free movement of at least one weft thread in reciprocal motion solely by gravitational forces across the path of said warp threads in a transverse direction to the direction of said warp threads advance; and means for selectively arranging each of said warp threads in an upper or lower position to form a shed through which said shuttle means passes, said means being hingedly connected to said warp thread advancement means and said shuttle means;

said means for selectively arranging each of said warp threads comprising movable warp thread holding means cooperating with means for transporting a pattern member adapted to determine the relative position of each warp thread in conformance with preselected instructions contained upon said pattern member;

said pattern member transport means being adapted to selectively advance in synchronism with said warp threads, move in a direction opposite to the direction of the warp thread advancement, or remain static as said warp threads advance;

whereby a woven fabric of a varied weave and pattern may be obtained as said warp threads advance.

5. A loom assembly as claimed in claim 4 wherein said shuttle means includes a shuttle holder adapted to hold at least one shuttle, each such shuttle having a weft thread holding member, the base of which includes recessed magnetic means adapted to be magnetically attracted to said upright reed members, and which further includes a plurality of axled rollers which are unrestricted in rotational movement, but the axles of which, in a horizontal plane, have differing degees of restraint, whereby as said shuttle means advances along said shuttle board on said rollers, the rollers advance at a slight angular deviation to the direction of travel of the shuttle means, and the shuttle means adheres to the shuttle board.

6. In a hand loom, the combination comprising:

means for uniformly advancing a plurality of warp threads in a first direction;

shuttle means for free movement of at least one weft thread in reciprocal motion across the path of said warp threads solely by gravitational forces, said shuttle means including roller means transporting said shuttle means transversely to the direction of warp thread advance, said roller means having a direction of travel which is at a slight angular deviation from the direction of travel of said shuttle means; and means for selectively arranging each of said warp threads in an upper or lower position to form a shed through which said shuttle means passes;

said means for selectively arranging each of said warp threads comprising movable warp thread holding means cooperating with means for transporting a pattern member adapted to determine the relative position of each warp thread in conformance with preselected instructions contained in said pattern member;

said pattern member transport means being adapted to selectively advance in synchronism with said warp threads, move in a direction opposite to the direction of the warp thread advancement, or remain static as said warp threads advance;

whereby a woven fabric of a varied weave and pattern may be obtained as said warp threads advance.

7. A loom assembly comprising:

a base member including at least two essentially parallel longitudinal side members;

a warp roller rotatably secured at one end of said base between said side members;

a take-up roller rotatably secured at the other end of said base between said side members;

said rollers being rotatable only in the same direction, thereby being adapted to carry warp thread from the first roller to the second.

a warp bar arranged intermediate said rollers and between said side members, said warp bar having a plurality of heddles slidably mounted thereon for vertical, alternate reciprocation and when having warp thread therein, the rising of one heddle and the falling of an adjacent heddle providing alternate warp threads in spaced relation to form a shed;

a shuttle board arranged between said side members adjacent said warp bar in the direction of the take-up roller, said shuttle board having a plurality of upright metallic reeds thereon to align the warp threads as they travel from the warp roller through the heddles to the take-up roller;

shuttle means for moving at least one weft thread solely by gravitational forces in reciprocal motion on the surface of said shuttle board across the path of said warp threads in a transverse direction as said warp threads advance;

said shuttle means including a shuttle holder adapted to hold at least one shuttle, each such shuttle having a weft thread holding member, the base of which includes a plurality of axled rollers which are unrestricted in rotational movement, but the axles of which, in a horizontal plane, have differing degrees of restraint, whereby as said shuttle means advances along said shuttle board on said rollers, the rollers advance at a slight angular deviation to the direction of travel of the shuttle means;

means for arranging a preprogrammed pattern member in cooperative relationship with said heddle members to determine the relative position of each warp thread in said heddle member in conformance with preselected instructions contained upon said pattern member;

said arrangement means being adapted to selectively advance, immobilize, or reverse the direction of movement of said pattern member as said warp threads advance from the first roller to the second; and said base member, take-up and warp rollers, warp bar, shuttle board and shuttle means together being movable in a vertical plane away from said pattern arrangement means which nests among them to permit ready insertion or removal of preprogrammed pattern members in said pattern arrangement means.

8. In a hand loom, the combination comprising:

means for uniformly advancing a plurality of warp threads in a first direction;

shuttle means including a shuttle board for free movement of at least one weft thread in reciprocal motion solely by gravitational forces across the path of said warp threads in a transverse direction to the direction of said warp threads advance; and means for selectively arranging each of said warp threads in an upper or lower position to form a shed through which said shuttle means passes, said means being hingedly connected to said warp thread advancement means and said shuttle means;

said means for selectively arranging each of said warp threads comprising movable warp thread holding means cooperating with means for transporting a pattern member adapted to determine the relative position of each warp thread in conformance with preselected instructions contained upon said pattern member;

said pattern member transport means being adapted to selectively advance in synchronism with said warp threads, move in a direction opposite to the direction of the warp thread advancement, or remain static as said warp threads advance; and means to maintain even width of the web formed by the weaving of warp and weft threads comprising selvedge holders arranged over the extreme right and left warps, and temples arranged to hold said selvedge holders apart to the desired width, whereby a woven fabric of a varied weave and pattern may be obtained as said warp threads advance.

9. In a hand loom, the combination comprising:

means for uniformly advancing a plurality of warp threads in a first direction;

shuttle means including a shuttle board for free movement of at least one weft thread in reciprocal motion solely by gravitational forces across the path of said warp threads in a transverse direction to the direction of said warp threads advance; and means for selectively arranging each of said warp threads in an upper or lower position to form a shed through which said shuttle means passes, said means being hingedly connected to said warp thread advancement means and said shuttle means;

said means for selectively arranging each of said warp threads comprising movable warp thread holding means cooperating with means for transporting a pattern member adapted to determine the relative position of each warp thread in conformance with preselected instructions contained upon said pattern member;

said pattern member transport means being adapted to selectively advance in synchronism with said warp threads, move in a direction opposite to the direction of the warp thread advancement, or remain static as said warp threads advance; and in addition, a finger weaving unit arranged in proximity to the shuttle board, said finger weaving unit comprising:

a warp holder, a warp holder extension which accommodates vertical movement of said warp holder, a cross bar on which is mounted said warp holder extension, and warp separator extensions having a ramped surface arranged upon said warp holder, whereby the warp holder may be raised or lowered along the warp holder extension at any place under the warp threads at any position to the right or left of the loom assembly as the warp holder extension is moved along the cross bar, and the warp threads are spread out at small distances from each other as the warp holder is arranged in its upward position to make the warp threads more accessible for finger weaving;

whereby a woven fabric of a varied weave and pattern may be obtained as said warp threads advance.

10. In a hand loom, the combination comprising:

means for uniformly advancing a plurality of warp threads in a first direction;

shuttle means including a shuttle board for free movement of at least one weft thread in reciprocal motion solely by gravitational forces across the path of said warp threads in a transverse direction to the direction of said warp threads advance; and means for selectively arranging each of said warp threads in an upper or lower position to form a shed through which said shuttle means passes, said means being hingedly connected to said warp thread advancement means and said shuttle means;

said means for selectively arranging each of said warp threads comprising movable warp threads holding means cooperating with means for transporting a pattern member adapted to determine the relative position of each warp thread in conformance with preselected instructions contained upon said pattern member;

said pattern member transport means being adapted to selectively advance in synchronism with said warp threads, move in a direction opposite to the direction of the warp thread advancement, or remain static as said warp threads advance; and in addition, a pair of warp holding sticks comprising:

an adjustable warp frame, having two lateral side members;

two extendable coil springs extended parallel to each other on one of said two lateral side members, said coil springs being adapted to receive a single warp thread between each adjacent pair of coils within each said coil spring when said coil springs are extended; and a rigid member inserted laterally through the length of each coil spring to render it rigid;

said lateral side member on which said coil springs are mounted having a slot therein to ease the cutting of warp threads extending between said coil springs, thereby releasing two warp-holding sticks for placement on the loom assembly;

wherein a woven fabric of a varied weave and pattern may be obtained as said warp threads advance.

* * * * *